US006037917A

United States Patent [19]

Kawakami

[11] Patent Number: 6,037,917

[45] Date of Patent: Mar. 14, 2000

[54] PLASMA DISPLAY SYSTEM

[75] Inventor: Yoshiya Kawakami, Tokyo, Japan

[73] Assignee: NEC Corporation, Tokyo, Japan

[21] Appl. No.: 08/998,842

[22] Filed: Dec. 29, 1997

[30] Foreign Application Priority Data

Dec. 25, 1996 [JP] Japan ..... 8-345043

[51] Int. Cl.[7] ..... G09G 3/28; G09G 5/10

[52] U.S. Cl. ..... 345/63; 345/60; 345/147

[58] Field of Search ..... 345/147, 60, 63

[56] References Cited

U.S. PATENT DOCUMENTS 5,757,343 5/1998 Nagakubo ..... 345/63
5,818,419 10/1998 Tajima et al. ..... 345/147

FOREIGN PATENT DOCUMENTS 0344623 12/1989 European Pat. Off. .
0653740 5/1995 European Pat. Off. .
1-163794 6/1989 Japan .
7-229896 8/1992 Japan .
7-219474 8/1995 Japan .
8-76716 3/1996 Japan .
8-305321 11/1996 Japan .

*Primary Examiner*—Richard A. Hjerpe
*Assistant Examiner*—Duc Dinh
*Attorney, Agent, or Firm*—Sughrue, Mion, Zinn, Macpeak & Seas, PLLC

[57] ABSTRACT

A plasma display adopting a sub-field scheme drive, which seeks to reduce light intensity level variation when the input video signal field frequency is varied. A sub-field setter 2 sets a plurality of sub-fields from the 1-st one (SF1) to an n-th one (SFn) with light intensity level ratios of $2^{n-1}:2^{n-2}$, . . . , 2:1. A sustained discharge pulse number controller 3 generates sustained discharge pulses for sustained light emission. The sustained discharge pulses are generated in numbers, which correspond to the relative light intensity levels of the individual sub-fields, and are controlled according to the rate of change in the input video signal field frequency from a reference field frequency.

8 Claims, 6 Drawing Sheets

PLASMA DISPLAY SYSTEM

BACKGROUND OF THE INVENTION

The present invention relates to plasma display systems and, more particularly, to a method of light intensity level compensation in accordance with the field frequency of an input video signal.

In a plasma display, its drive input voltage and light emission output are non-linearly related, so that it cannot display an input video signal as images with analog light intensity level gradations. Accordingly, the light "on" period is divided into divisions, and gradations are provided by whether or not light is to be "on" in each division, that is, in terms of the number of divisions, in which light is "on". For example, a sub-field scheme as shown in FIG. 6(*a*) is used, in which one field is constituted with a plurality of sub-fields (SF) with different light "on" period ratios (proportional to the light intensity level). The video signal is converted into digital data of bits corresponding in number to the number of the sub-fields in the field, and this data is used to cause the light emission from corresponding image elements in an appropriate sub-field (or a plurality of appropriate sub-fields).

As an example, a plasma display will now be considered, which uses an AC discharge memory type plasma display panel having a plurality of photo-cell scan electrodes, sustained discharge electrodes paired with and formed on the same plane as the respective photo-cell scan electrodes, a plurality of data electrodes crossing the photo-cell scan and sustained discharge electrodes, and a plurality of photo-cells formed for display at the intersections of the photo-cell scan and sustained discharge electrodes and the data electrodes. The sub-field scheme which is adopted in this example, is of a discrete photo-cell scan/sustained discharge type, in which one field is constituted by n sub-fields with video signal light intensity level ratios of $2^{n-1}:2^{n-2}, \ldots, 2:1$. Each sub-field has a photo-cell scan period P for determining the period of "on" or "off" of the photo-cells, a sustained discharge period S for repeatedly discharging on the basis of selective discharge in the photo-cell scan period, and a preliminary discharge period for preliminary discharge prior to the photo-cell scan period. A light emission sequence is arranged by setting progressively reduced sustained discharge pulse numbers in the sustained discharge periods of the successive sub-fields and thus setting a fixed basic light intensity level such that the light intensity level ratios of the successive sub-fields are $2^{n-1}:2^{n-2}, \ldots, 2:1$. With such light intensity level combination of the n sub-fields, a video signal is displayed as multiple gradation display.

In this type of prior art plasma display, a sub-field sequence is formed with a certain fixed field frequency as a reference frequency. This arrangement permits display of video signal at a field frequency lower than the reference frequency. In this case, however, the drive period is reduced compared to the field period, thus resulting in a pause period from the instant of the end of the drive operation in a field till the instant of the start of that in the next field. This means a variation of the apparent drive frequency, i.e., a variation of the input video signal field frequency, thus resulting in a light intensity level variation.

The prior art plasma display has a problem that the light intensity level of display is varied with a variation of the field frequency of the video signal to be displayed because of the sub-field sequence configuration, which is based on the maximum field frequency, i.e., the upper limit field frequency, of video signal that can be displayed.

The field frequency of video signal which is actually displayed, ranges from about 50 to about 75 Hz. When a video signal of field frequency 50 Hz is displayed with a sub-field sequence which is formed with a reference field frequency of 75 Hz, the light intensity level is reduced by about 30%, and the display is visually recognized to be darker.

The reason for this is as follows. The prior art plasma display adopts a fixed sub-field sequence for the driving, which is formed by using, as a reference frequency, the vertical sync signal frequency (which is 60 Hz in the prior art example shown in FIG. 6(*a*)), i.e., the highest frequency in video signal capable of being displayed on the plasma display. With such a fixed sub-field sequence, a field frequency change in such case as when the input video signal is switched, does not cause any change in the sustained light emission period. Such a fixed sub-field sequence results in an inter-field drive pause period R shown in FIG. 6(*b*) for instance, when the displayed video signal is switched to one at a field frequency lower than the reference field frequency. The apparent drive frequency is therefore reduced to reduce the light intensity level of display.

In the display adopting a sub-field scheme for multiple gradation, using a fixed sub-field sequence for displaying different kinds of video signals, results in video signal field frequency variations to vary the light intensity level.

SUMMARY OF THE INVENTION

An object of the present invention, accordingly, is to provide a plasma display capable of reducing the light intensity level variation when a video signal at a different field frequency is inputted.

According to the present invention, the sustained discharge pulses are applied in suitable numbers according to the input video signal field frequency, and thus different input video signal field frequencies lead to apparent drive frequencies which are close to one another.

According to an aspect of the present invention, there is provided a plasma display for displaying a multiple gradation video signal with each field thereof constituted by a plurality of sub-fields with different numbers of sustained discharge pulses, wherein the sustained discharge pulse numbers of the sub-fields are reduced when the input video signal field frequency becomes higher than a reference field frequency and increased when the input video signal field frequency becomes lower than the reference field frequency.

A video signal field frequency range which allows display is divided into two or more frequency sub-ranges, and the sustained discharge pulse numbers are set such that a fixed light intensity level of display is obtained at typical video signal frequencies in the individual frequency sub-ranges.

The sustained discharge pulse numbers are controlled according to the input video signal field frequency change rate to control the light intensity level of display to a reference level, which is obtained when video signal at a fixed field frequency is displayed, regardless of input video signal field frequency changes.

The sustained discharge pulse numbers are controlled according to the input video signal field frequency change rate to control the light intensity level of display to a reference level, which is obtained when the maximum field frequency video signal capable of being displayed is displayed, regardless of input video signal field frequency changes.

According to another aspect of the present invention, there provided a plasma display for displaying multiple gradation video signal with each field thereof constituted by a plurality of sub-fields with different sustained discharge pulse numbers, which comprises a sustained discharge pulse number controller for controlling the sustained discharge pulse numbers of the sub-fields according to the video signal field frequency to control the light intensity level of display to be constant.

According to other aspect of the present invention, there is provided a plasma display for displaying multiple gradation video signal with each field thereof comprising, a sync separator for separating a sync signal from an input video signal, a sub-field setter for setting n sub-fields from the 1-st one to the n-th one with respective light intensity level ratio of $2^{n-1}:2^{n-2}, \ldots 2:1$ on the basis of a vertical sync signal from the sync separator, a sustained discharge pulse number controller for generating sustained discharge pulses in numbers necessary for sustained light emission corresponding to the relative light intensity levels of emission of the sub-fields, the sustained discharge pulse numbers being controlled in correspondence to the rate of change in the field frequency of the input video signal for a reference field frequency, an A/D converter for converting an analog video signal into an n-bit digital video signal when the number of bits corresponding to the respective sub-fields, a frame memory for storing one field of digitally converted video signal, a driver for driving a plasma display panel according to data read out from the frame memory and the outputting signals from the sub-field setter and the sustained discharge pulse number controller, wherein the sub-field sequence is composed with reference to a predetermined reference field frequency, in each sub-field the first half consisting of a preliminary discharge period and a photo-cell scan period, and the second half consisting of a sustained discharge period, in which sustained discharge pulses are applied in number corresponding to a reference light intensity level, when the video signal field frequency is lower than the reference field frequency, the sub-field setter extends the sustained pulse application periods in the same ratio according to the field frequency, and the sustained discharge pulse number controller increases the sustained discharge pulse numbers to keep the reference light intensity level, and when the video signal field frequency is higher than the reference field frequency, the sub-field setter contracts the sustained discharge application periods in the same ratio according to the field frequency and the sustained discharge pulse number controller reduces the sustained discharge pulse numbers to keep the reference light intensity level.

According to still other aspect of the present invention, there is provided a plasma display for displaying multiple gradation video signal with each field thereof comprising, a sync separator for separating a sync signal from an input video signal, a sub-field setter for setting n sub-fields from the 1-st one to the n-th one with respective light intensity level ratio of $2^{n-1}:2^{n-2}, \ldots, 2:1$ on the basis of a vertical sync signal from the sync separator, a sustained discharge pulse number controller for generating sustained discharge pulses in numbers necessary for sustained light emission corresponding to the relative light intensity levels of emission of the sub-fields, the sustained discharge pulse numbers being controlled in correspondence to the rate of change in the field frequency of the input video signal for a reference field frequency, an A/D converter for converting an analog video signal into an n-bit digital video signal when the number of bits corresponding to the respective sub-fields, a frame memory for storing one field of digitally converted video signal, a driver for driving a plasma display panel according to data read out from the frame memory and the outputting signals from the sub-field setter and the sustained discharge pulse number controller, wherein the sub-field sequence is composed with reference to the maximum field frequency at which the video signal can be displayed, the sub-field setter determines the duration of each sub-field, with the first half thereof consisting of a preliminary discharge period and a photo-cell scan period, and the second half consisting of a sustained discharge period, sustained discharge pulses are applied in number corresponding to a time, which corresponds to the reference field frequency, the sustained discharge pulse number controller controls the sustained pulse number such as to provide a reference light intensity level, when a video signal of a field frequency is lower than the reference field frequency, and the sustained discharge pulse number controller increases the sustained discharge pulse numbers of the sub-fields by increasing the sustained discharge pulse frequencies thereof by the same ratio in correspondence to the field frequency change rate.

According to other aspect of the present invention, there is provided a plasma display for displaying multiple gradation video signal with each field thereof comprising, a sync separator for separating a sync signal from an input video signal, a sub-field setter for setting n sub-fields from the 1-st one to the n-th one with respective light intensity level ratio of $2^{n-1}:2^{n-2}, \ldots, 2:1$ on the basis of a vertical sync signal from the sync separator, a sustained discharge pulse number controller for generating sustained discharge pulses in numbers necessary for sustained light emission corresponding to the relative light intensity levels of emission of the sub-fields, the sustained discharge pulse numbers being controlled in correspondence to the rate of change in the field frequency of the input video signal for a reference field frequency, an A/D converter for converting an analog video signal into an n-bit digital video signal when the number of bits corresponding to the respective sub-fields, a frame memory for storing one field of digitally converted video signal, a driver for driving a plasma display panel according to data read out from the frame memory and the outputting signals from the sub-field setter and the sustained discharge pulse number controller, wherein the sub-field sequence is composed with reference to the maximum field frequency at which the video signal can be displayed, the sub-field setter determines the duration of each sub-field, with the first half thereof consisting of a preliminary discharge period and a photo-cell scan period, and the latter half consisting of a sustained discharge period, in which sustained discharge pulses are applied in number corresponding to a time which corresponds to the reference field frequency, the sustained discharge pulse number controller determines each sustained discharge pulse number by setting a sustained discharge pause period to provide a reference light intensity level, when a video signal at a field frequency is lower than the reference field frequency, the sustained discharge pulse number controller increases the sustained discharge pulse numbers in the sub-fields by contracting the sustained discharge pause periods therein in the same ratio in correspondence to the field frequency change rate.

Other objects and features will be clarified from the following description with reference to attached drawings.

BRIEF DESCRIPTION OF THE DRAWINGS

PREFERRED EMBODIMENTS OF THE INVENTION le;.5qPreferred embodiments of the present invention will now be described with reference to the drawings. FIG. 1 is a block diagram showing an application of the present invention to a plasma display based on a discrete photo-cell scan/sustained discharge type sub-field scheme. A sync separator 1 separates a sync signal from an input video signal. A sub-field setter 2 sets n sub-fields from the 1-st one (SF1) to the n-th one (SFn) with respective light intensity level ratio of $2^{n-1}:2^{n-2}, \ldots, 2:1$ on the basis of a vertical sync signal from the sync separator 1. A sustained discharge pulse number controller 3 generates sustained discharge pulses in numbers necessary for sustained light emission corresponding to the relative light intensity levels of emission of the sub-fields. The sustained discharge pulse numbers are controlled in correspondence to the rate of change in the field frequency of the input video signal for a reference field frequency.

Figure 1:
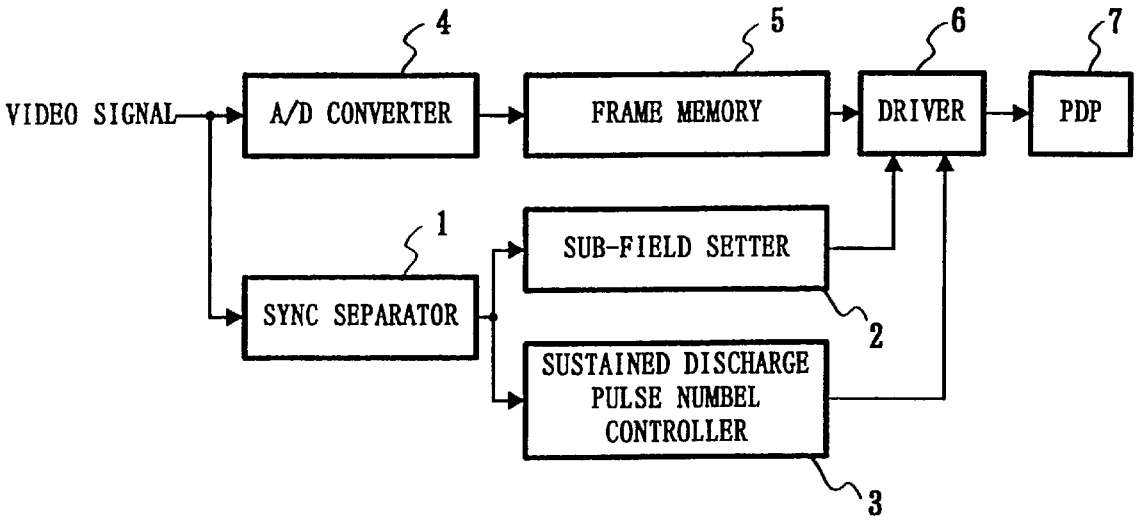
FIG. 1 shows a block diagram showing an application of the present invention to a plasma display based on a discrete photo-cell scan/sustained discharge type sub-field scheme.

An A/D converter 4 converts an analog video signal into an n-bit digital video signal when the number of bits corresponding to the respective sub-fields, i.e., the number of the sub-fields, is n. A frame memory 5 stores one field of digitally converted video signal.

A driver 6 drives a plasma display panel (PDP) 7 according to data read out from the frame memory 5 and the output signals from the sub-field setter 2 and the sustained discharge pulse number controller 3.

Figure 2:
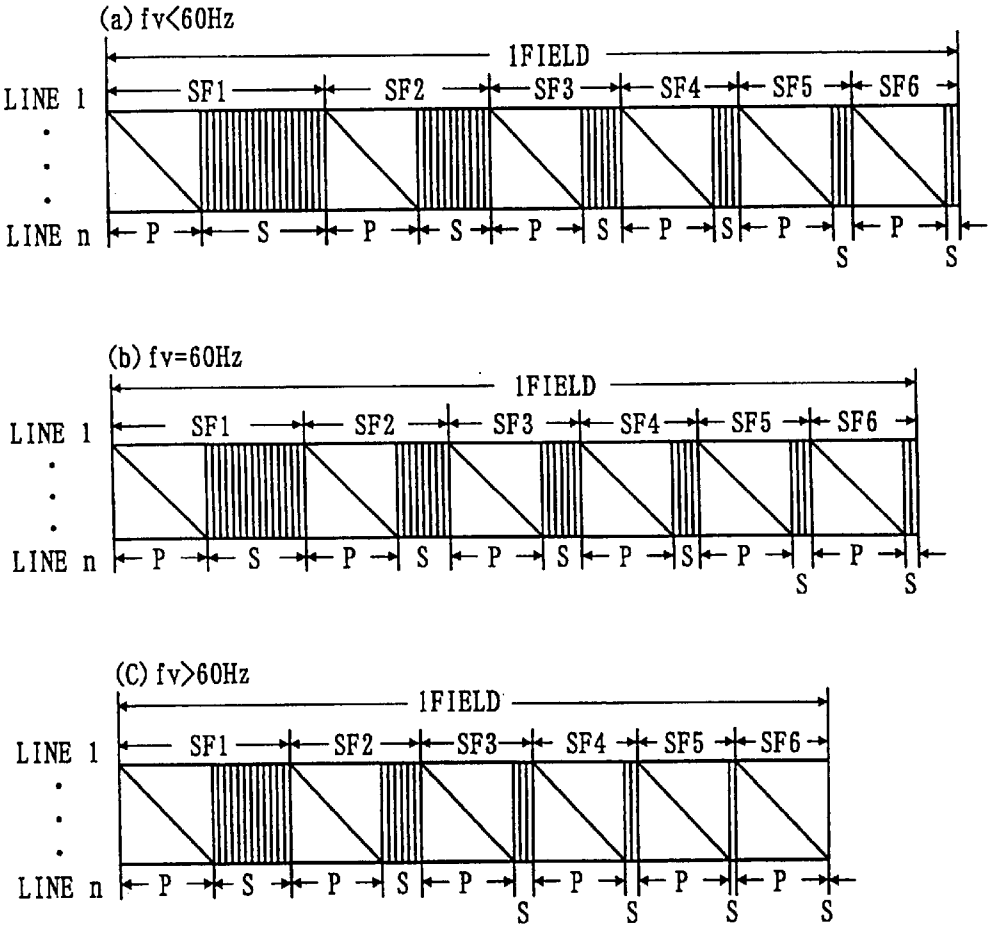
FIGS. 2(*a*) to 2(*c*) show sub-field sequences which are provided in a first embodiment of the present invention.

A first embodiment of the present invention applied to a discrete photo-cell scan/sustained discharge type sub-field scheme plasma display will now be described in detail by also having reference to FIGS. 2(*a*) to 2(*c*). FIGS. 2(*a*) to 2(*c*) show sub-field sequences which are provided in the first embodiment. The sub-field sequence shown in FIG. 2(*b*), is provided in the case where the video signal field frequency fv is a reference field frequency of 60 Hz. In each sub-field SF, the first half consists of a preliminary discharge period and a photo-cell scan period P, and the second half consists of a sustained discharge period S, in which sustained discharge pulses are applied in number corresponding to a reference light intensity level. The sub-field sequence shown in FIG. 2(*a*) is provided in the case where the video signal field frequency fv is lower than 60 Hz. In this case, the sub-field setter 2 extends the sustained pulse application periods, i.e., the sustained discharge periods S in the individual sub-fields in the same ratio according to the field frequency fv, i.e., in correspondence to the field frequency change rate, and the sustained discharge pulse number controller 3 increases the sustained discharge pulse numbers to keep the reference light intensity level.

The sub-field sequence shown in FIG. 2(*c*) is provided in the case where the video signal field frequency is higher than 60 Hz. In this case, the sub-field setter 2 contracts the sustained discharge application periods, i.e., the sustained discharge periods S, in the sub-fields in the same ratio according to the field frequency fv, i.e., in correspondence to the field frequency change rate, and the sustained discharge pulse number controller 3 reduces the sustained discharge pulse numbers to keep the reference light intensity level.

When a video signal at a field frequency lower than the reference field frequency is displayed without changing the sustained discharge pulse numbers, the light intensity level is reduced. In the case of a video signal at a field frequency higher than the reference field frequency, on the other hand, the light intensity level is increased. It will be seen that the light intensity level (i.e., number of increase or decrease of the sustained discharge pulse numbers) is changed in inverse proportion to the field frequency.

The light intensity level is determined by how many times the light emission is caused, that is, how many sustained discharge pulses are applied, in one second. The sustained discharge pulse number corresponding to the field frequency of a video signal to be displayed, thus can be expressed as:

$$\text{(sustained discharge pulse number)} = \text{(reference frequency fv)}/\text{(display frequency fv)} \times \text{(reference sustained discharge pulse number)} \quad (1)$$

Assuming the sustained discharge pulse frequency to be 160 kHz, for instance, the pulse cycle is 6.25 $\mu$s. Then, assuming the sustained discharge pulse number of the most significant bit sub-field in the case of the reference field frequency (60 Hz) to be 128, the sustained discharge period is 800 $\mu$s. In the first embodiment, in which the sustained discharge pulse number is changed in proportion to the sustained discharge period, formula (1) can be reduced to:

$$\text{(sustained discharge period)} = \text{(reference frequency fv/display frequency fv)} \times (800\ \mu s) \quad (2)$$

In the case where the field frequency of the video signal to be displayed is 50 Hz, the sustained discharge period is:

$$\text{(sustained discharge period)} = 60 \div 50 \times 800 = 960\ \mu s \quad (3)$$

and the corresponding sustained discharge pulse number is:

$$\text{(sustained discharge pulse number)} = 960 \times 128 \div 800 = 154 \quad (4)$$

In the case where the field frequency of the video signal to be displayed is 75 Hz, the sustained discharge period is:

$$\text{(sustained discharge period)} = 60 \div 70 \times 800 = 640\ \mu s \quad (5)$$

and the corresponding sustained discharge pulse number is:

$$(\text{sustained discharge pulse number}) = 64 \times 128 \div 800 = 102 \quad (6)$$

Figure 3:
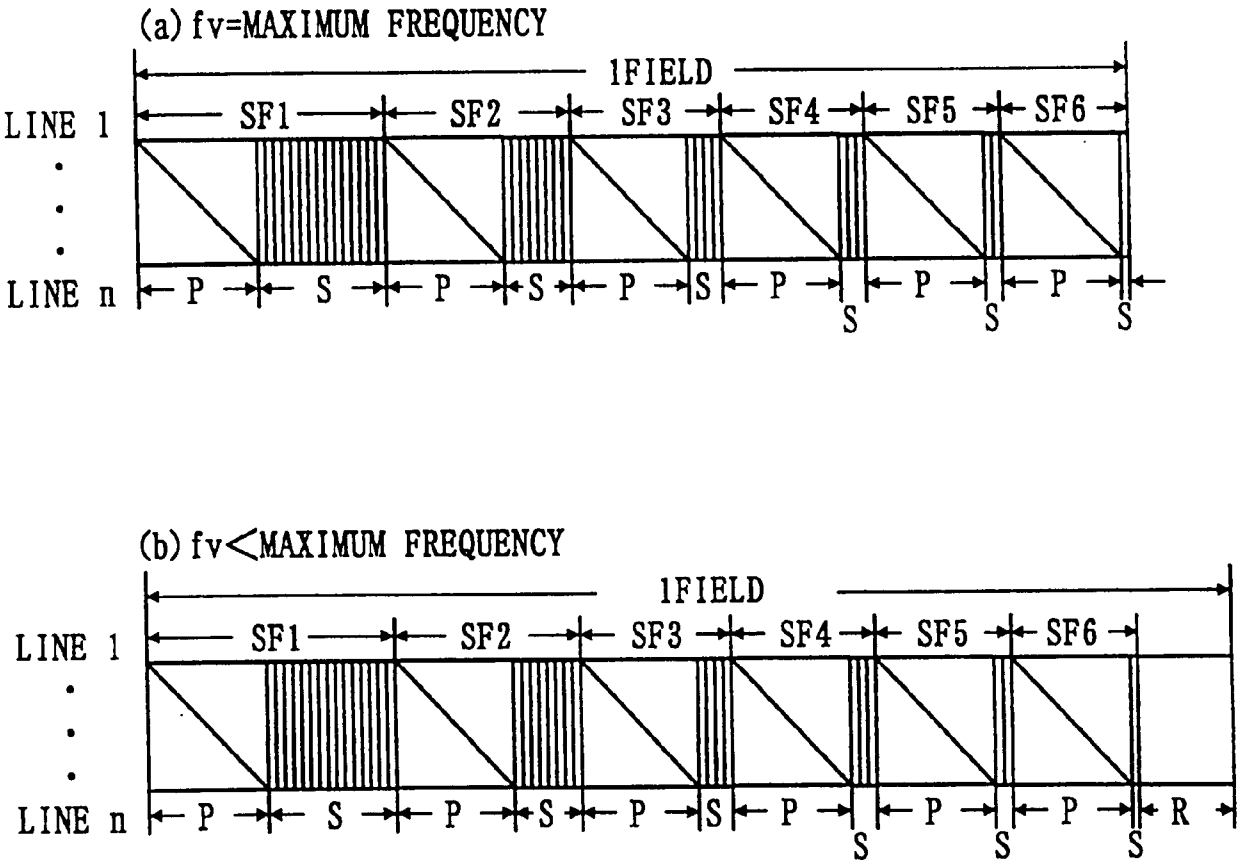
FIGS. 3(*a*) and 3(*b*) shows sub-field sequences which are provided in a second embodiment of the present invention.

A second embodiment of the present invention, which is again applied to a discrete photo-cell scan/sustained discharge type sub-field scheme plasma display, will now be described. In this embodiment, the reference field frequency is the maximum field frequency, i.e., the upper limit frequency, at which the video signal can be displayed. FIGS. 3(*a*) and 3(*b*) shows sub-field sequences which are provided in this embodiment. The sub-field sequence shown in FIG. 3(*a*), is provided in the case where the field frequency fv of the video signal to be displayed is the reference frequency. The sub-field setter 2 determines the duration of each sub-field, with the first half thereof consisting of a preliminary discharge period and a photo-cell scan period, and the second half consisting of a sustained discharge period, sustained discharge pulses are applied in number corresponding to a time, which corresponds to the reference field frequency. The sustained discharge pulse number controller 3 controls the sustained pulse number such as to provide a reference light intensity level.

The sub-field sequence shown in FIG. 3(*b*) is provided in the case where a video signal of a field frequency lower than the reference field frequency is displayed. In this case, the sustained discharge pulse number controller 3 increases the sustained discharge pulse numbers of the sub-fields by increasing the sustained discharge pulse frequencies thereof by the same ratio in correspondence to the field frequency change rate, thus providing the reference light intensity level without any change.

In the second embodiment, in which the sustained discharge pulse number is changed in correspondence to the sustained discharge pulse frequency, assuming the reference field frequency to be 60 Hz, formula (1) is expressed by formula (7)

$$(\text{sustained pulse frequency}) = (\text{reference fv/display fv}) \times (160\ \text{kHz}) \quad (7)$$

In the case where the field frequency of the video signal to be displayed is 50 Hz, the sustained discharge pulse frequency is $$(\text{sustained discharge pulse frequency}) = 60 \div 50 \times 160 = 192\ \text{kHz} \quad (8)$$

and the corresponding sustained discharge pulse number in the sustained discharge period is $$(\text{sustained discharge pulse number}) = 192 \times 128 \div 160 = 154 \quad (9)$$

Figure 4:
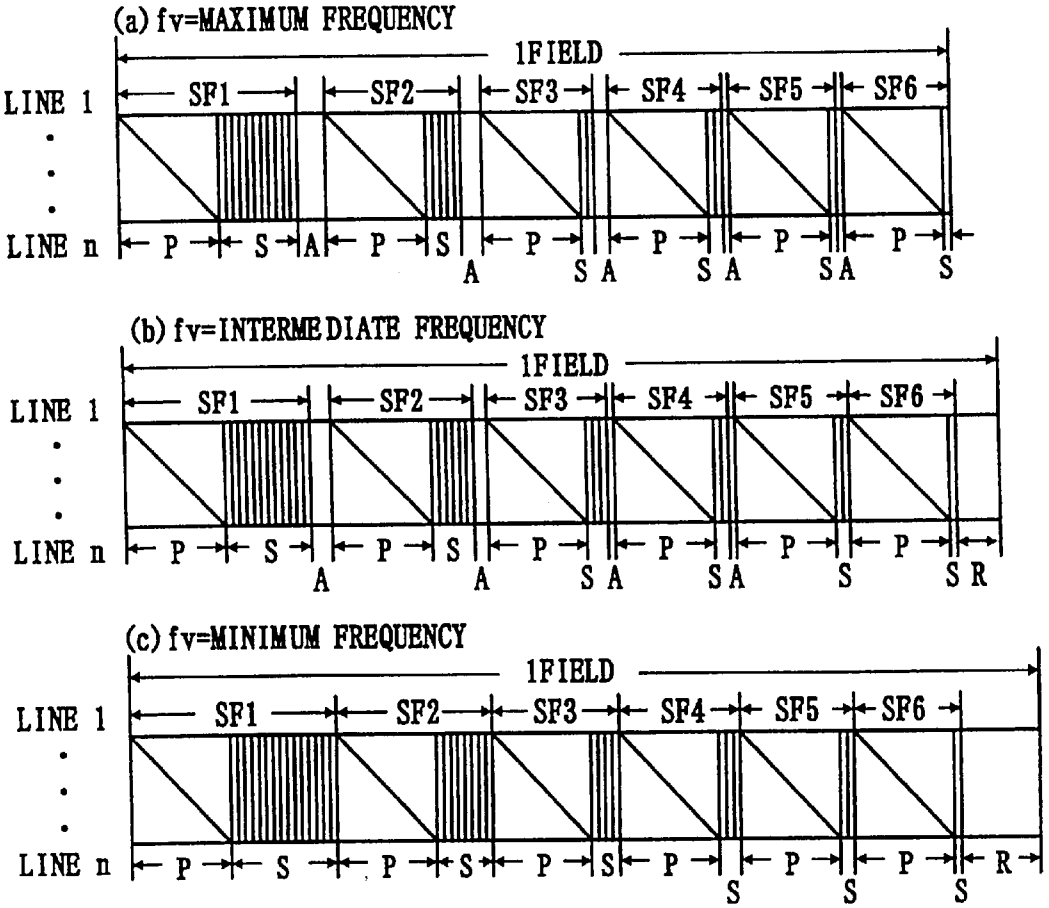
FIGS. 4(*a*) to 4(*c*) show sub-field sequences which are provided in a third embodiment of the present invention.

A third embodiment of the present invention, which is again applied to a discrete photo-cell scan/sustained discharge type sub-field scheme plasma display, will be described. Again in this embodiment, the reference field frequency is the maximum field frequency, i.e., the upper limit frequency, at which the video signal can be displayed. FIGS. 4(*a*) to 4(*c*) show sub-field sequences which are provided in this embodiment. As shown in FIG. 4(*a*), the reference frequency is provided in the case of displaying a video signal at the maximum field frequency of the video signal capable of being displayed. The sub-field setter 2 determines the duration of each sub-field, with the first half thereof consisting of a preliminary discharge period and a photo-cell scan period, and the latter half consisting of a sustained discharge period, in which sustained discharge pulses are applied in number corresponding to a time which corresponds to the reference field frequency. The sustained discharge pulse number controller 3 determines each sustained discharge pulse number by setting a sustained discharge pause period A to provide a reference light intensity level. This is made so in order to cope with lower field frequencies.

The sub-field sequence as shown in FIG. 4(*b*) is provided in the case of displaying a video signal at a field frequency (intermediate field frequency) lower than the reference field frequency. In this case, the sustained discharge pulse number controller 3 increases the sustained discharge pulse numbers in the sub-fields by contracting the sustained discharge pause periods A therein in the same ratio in correspondence to the field frequency change rate, thus providing the reference light intensity level without change. The sub-field sequence aa shown in FIG. 4(*c*) is provided when the field frequency becomes minimum, i.e., the lower limit field frequency at which the video signal can be displayed. In this case, each sub-field does not include any sustained discharge pause period, and its sustained discharge pulse number is maximum.

Where the sustained discharge pulse numbers are controlled in correspondence to the field frequency change rate as in the above first to third embodiments, sustained discharge pulse numbers of sub-fields providing relatively low light intensity levels of emission, may have decimal fractions in computation. Sub-fields providing lower light intensity levels less affects the light intensity level compensation according to the present invention. For this reason, the decimal fractions may be raised in the upward control of the sustained discharge pulse numbers and cut off in the downward control.

Figure 5:
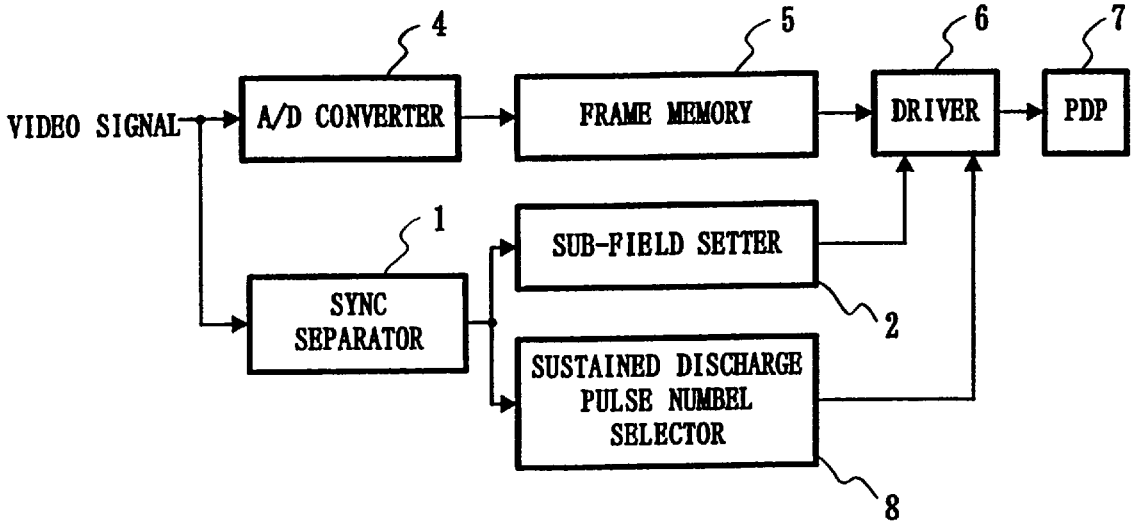
FIG. 5 shows an essential construction of the second embodiment of the present invention applied to the discrete photo-cell scan/sustained discharge type sub-field scheme plasma display.
Figure 6:
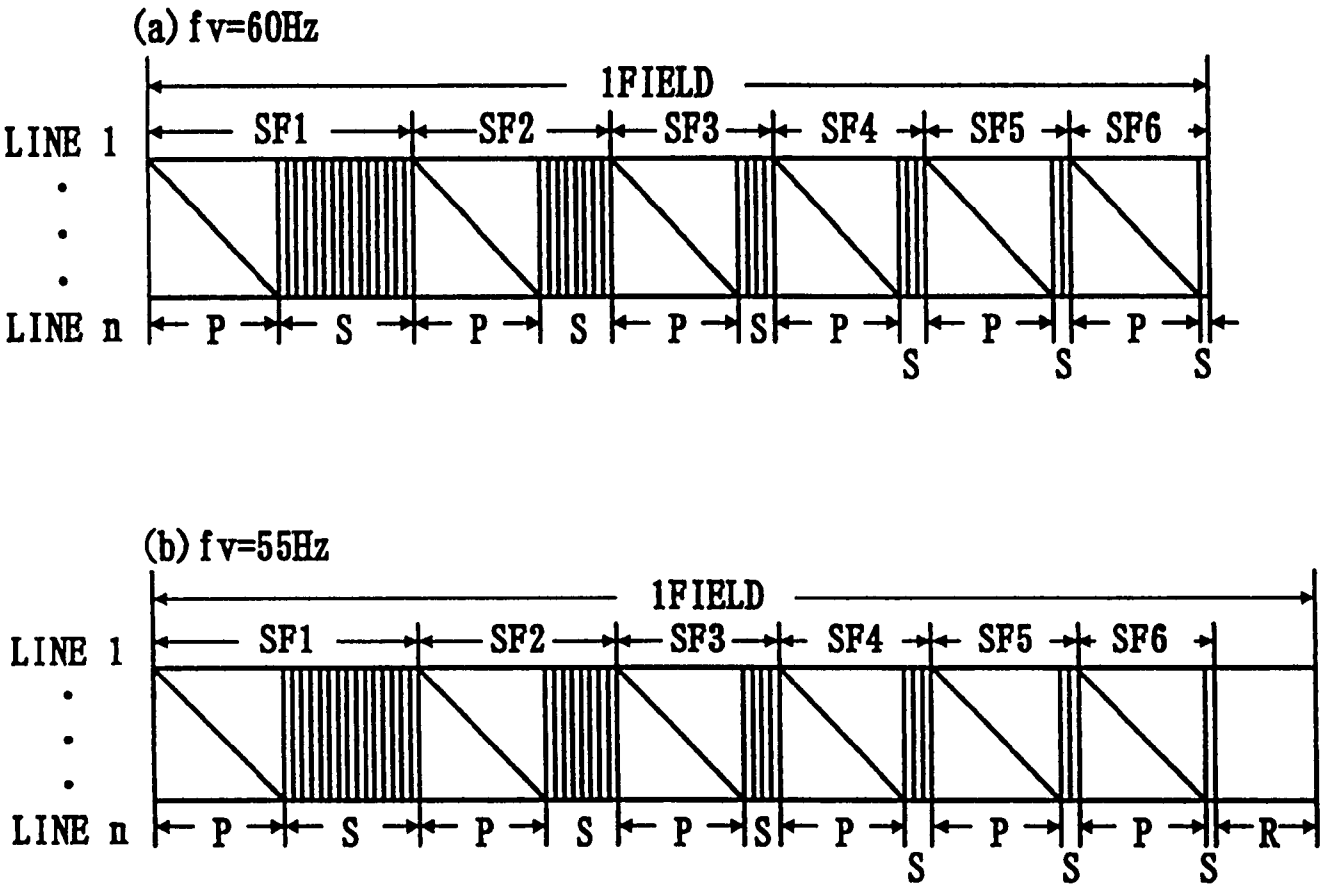
FIGS. 6(*a*) and 6(*b*) show sub-field sequences of the prior art.

The essential construction of the second embodiment of the present invention applied to the discrete photo-cell scan/sustained discharge type sub-field scheme plasma display, will now be described with reference to the block diagram of FIG. 5. This construction is the same as that of the first embodiment except for that a sustained discharge pulse number selector 8 is used in lieu of the sustained discharge pulse number controller 3. The sustained discharge pulse number selector 8 has a plurality of tables, in which sustained discharge pulse numbers of sub-fields are listed in correspondence to limited field frequencies, and sets sustained discharge pulse numbers by selecting a table suited for the input video signal field frequency. With the sustained discharge pulse number controller 3 in the first embodiment, the circuit scale is substantially fixed irrespective of the video signal field frequency range that is covered. The sustained discharge pulse number selector 8 in the second embodiment has an effect that it is possible to reduce the circuit scale in the case where the covered video signal field frequency range is somewhat narrow.

While the above embodiments of the present invention have concerned with the case of driving a surface discharge type AC discharge memory plasma display with a discrete photo-cell scan/sustained discharge sub-field scheme, the present invention is also applicable to AC discharge type plasma displays or DC type plasma displays based on other display systems or of other constructions, for instance of orthogonal two-electrode type, so long as a sub-field scheme is adopted for gradation display.

It is an effect of the present invention that it is possible to reduce light intensity level variations due to input video signal field frequency variations. This is so because the display is driven by adopting a sub-field sequence suited for the field frequency, i.e., a sub-field sequence, in which the sustained discharge pulse numbers can be controlled by controlling the sustained light emission period or the sustained discharge pulse cycle according to the field frequency.

The first embodiment permits fine setting of the sustained discharge pulse numbers and thus can flexibly cope with various kinds of video, so that it is very useful in the case where the video signal field frequency coverage is wide. The second and third embodiments permit sustained discharge pulse number control by controlling the sustained discharge pulse frequency or the sustained discharge pause period without altering the constitution of the sub-field sequence, and thus they can be readily realized to be simple in construction. Where the video signal field frequency coverage is relatively narrow, the third embodiment is further advantageous in that it permits suppressing an excessive light intensity level at a high field frequency by setting an optimum light intensity level for the minimum field frequency. This permits constant power consumption irrespective of the video signal field frequency, which is also advantageous from the standpoint of the power consumption reduction.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A plasma for displaying a multiple gradation video signal with each field thereof constituted by a plurality of sub-fields with different numbers of sustained discharge pulses, having a controller for reducing the sustained discharge pulse numbers of the sub-fields when an input video signal field frequency becomes higher than a reference field frequency and increasing the sustained discharge pulse numbers of the sub-fields when the input video signal field frequency becomes lower than the reference field frequency.

2. The plasma display according to claim 1, wherein a video signal field frequency range which allows for display is divided into two or more frequency sub-ranges, and the sustained discharge pulse numbers are set such that a fixed light intensity level of display is obtained at typical video signal frequencies in the individual frequency sub-ranges.

3. The plasma display according to claim 1, wherein the sustained discharge pulse numbers are controlled according to a input video signal field frequency change rate to control a light intensity level of display to a reference level, which is obtained when video signal at a fixed field frequency is displayed, regardless of input the video signal field frequency changes.

4. The plasma display according to claim 1, wherein the sustained discharge pulse numbers are controlled according to a input video signal field frequency change rate to control a light intensity level of display to a reference level, which is obtained when a maximum field frequency video signal capable of being displayed is displayed, regardless of input video signal field frequency changes.

5. A plasma display for displaying a multiple gradation video signal with each field thereof constituted by a plurality of sub-fields with different sustained discharge pulse numbers, which comprises a sustained discharge pulse number controller for controlling the sustained discharge pulse numbers of the sub-fields according to a video signal field frequency to control a light intensity level of display to be constant.

6. A plasma display for displaying a multiple gradation video signal with each field thereof comprising, a sync separator for separating a sync signal from an input video signal, a sub-field setter for setting n sub-fields from a 1-st one to a n-th one with respective light intensity level ratio of $2^{n-1}:2^{n-2}, \ldots, 2:1$ on the basis of a vertical sync signal from the sync separator, a sustained discharge pulse number controller for generating sustained discharge pulses in numbers necessary for sustained light emission corresponding to relative light intensity levels of emission of the sub-fields, the sustained discharge pulse numbers being controlled in correspondence to a rate of change in a field frequency of the input video signal for a reference field frequency, an A/D converter for converting an analog video signal into an n-bit digital video signal when a number of bits corresponding to respective sub-fields, a frame memory for storing one field of digitally converted video signal, a driver for driving a plasma display panel according to data read out from the frame memory and the outputting signals from the sub-field setter and the sustained discharge pulse number controller, wherein the sub-field sequence is composed with reference to a predetermined reference field frequency, in each sub-field a first half consisting of a preliminary discharge period and a photo-cell scan period, and a second half consisting of a sustained discharge period, in which sustained discharge pulses are applied in number corresponding to a reference light intensity level, when the video signal field frequency is lower than the reference field frequency, the sub-field setter extends the sustained pulse application periods in the same ratio according to the field frequency, and the sustained discharge pulse number controller increases the sustained discharge pulse numbers to keep the reference light intensity level, and when the video signal field frequency is higher than the reference field frequency, the sub-field setter contracts the sustained discharge application periods in the same ratio according to the field frequency and the sustained discharge pulse number controller reduces the sustained discharge pulse numbers to keep the reference light intensity level.

7. A plasma display for displaying a multiple gradation video signal with each field thereof comprising, a sync separator for separating a sync signal from an input video signal, a sub-field setter for setting n sub-fields from a 1-st one to a n-th one with respective light intensity level ratio of $2^{n-1}:2^{n-2}, \ldots 2:1$ on the basis of a vertical sync signal from the sync separator, a sustained discharge pulse number controller for generating sustained discharge pulses in numbers necessary for sustained light emission corresponding to a relative light intensity levels of emission of a sub-fields, the sustained discharge pulse numbers being controlled in correspondence to a rate of change in a field frequency of the input video signal for a reference field frequency, an A/D converter for converting an analog video signal into an n-bit digital video signal when a number of bits corresponding to respective sub-fields, a frame memory for storing one field of digitally converted video signal, a driver for driving a plasma display panel according to data read out from the frame memory and the outputting signals from the sub-field setter and the sustained discharge pulse number controller, wherein the sub-field sequence is composed with reference to a maximum field frequency at which the video signal can be displayed, the sub-field setter determines a duration of each sub-field, with the first half thereof consisting of a preliminary discharge period and a photo-cell scan period, and the second half consisting of a sustained discharge period, sustained discharge pulses are applied in number corresponding to a time, which corresponds to the reference field frequency, the sustained discharge pulse number controller controls the sustained pulse number to provide a reference light intensity level, when a video signal of a field frequency is lower than the reference field frequency, and the sustained discharge pulse number controller increases the sustained discharge pulse numbers of the sub-fields by increasing the sustained discharge pulse frequencies thereof by the same ratio in correspondence to the field frequency change rate.

8. A plasma display for di splaying a multiple gradation video signal with each field thereof comprising, a sync separator for separating a sync signal from an input video signal, a sub-field setter for setting n sub-fields from a 1-st one to a n-th one with respective light intensity level ratio of $2^{n-1}:2^{n-2}, \ldots, 2:1$ on the basis of a vertical sync signal from the sync separator, a sustained discharge pulse number controller for generating sustained discharge pulses in numbers necessary for sustained light emission corresponding to a relative light intensity levels of emission of the sub-fields, the sustained discharge pulse numbers being controlled in correspondence to a rate of change in a field frequency of the input video signal for a reference field frequency, an A/D converter for converting an analog video signal into an n-bit digital video signal when a number of bits corresponding to a respective sub-fields, a frame memory for storing one field of digitally converted video signal, a driver for driving a plasma display panel according to data read out from the frame memory and the outputting signals from the sub-field setter and the sustained discharge pulse number controller, wherein a sub-field sequence is composed with reference to a maximum field frequency at which the video signal can be displayed, the sub-field setter determines a duration of each sub-field, with the first half thereof consisting of a preliminary discharge period and a photo-cell scan period, and the latter half consisting of a sustained discharge period, in which sustained discharge pulses are applied in number corresponding to a time which corresponds to the reference field frequency, the sustained discharge pulse number controller determines each sustained discharge pulse number by setting a sustained discharge pause period to provide a reference light intensity level, when a video signal at a field frequency is lower than the reference field frequency, the sustained discharge pulse number controller increases the sustained discharge pulse numbers in the sub-fields by contracting the sustained discharge pause periods therein in the same ratio in correspondence to the field frequency change rate.

* * * * *